United States Patent [19]

Arieh et al.

[11] Patent Number: 4,575,958

[45] Date of Patent: Mar. 18, 1986

[54] SKI BOOT

[75] Inventors: Simon Arieh; Guy Courvoisier, both of Geneva, Switzerland

[73] Assignee: Lange International S.A., Fribourg, Switzerland

[21] Appl. No.: 635,900

[22] Filed: Jul. 30, 1984

[30] Foreign Application Priority Data

Aug. 29, 1983 [CH] Switzerland ..... 4711/83

[51] Int. Cl.[4] ..... A43B 5/04

[52] U.S. Cl. ..... 36/121; 36/50; 36/105

[58] Field of Search ..... 36/117–121, 36/50, 105; 24/68 SK, 69 SK, 70 SK, 71 SK

[56] References Cited

U.S. PATENT DOCUMENTS

| | | | |
|---|---|---|---|
| 3,405,463 | 10/1968 | Werner . | |
| 3,521,385 | 7/1970 | Dalebout . | |
| 3,543,421 | 12/1970 | Ader . | |
| 3,570,148 | 3/1971 | Morgan . | |
| 3,619,914 | 11/1971 | Hanson et al. . | |
| 3,633,291 | 1/1972 | Caporicci . | |
| 3,885,329 | 5/1975 | French . | |
| 4,096,651 | 6/1978 | Ancker . | |
| 4,265,034 | 5/1981 | Salomon | 36/121 |
| 4,326,320 | 4/1982 | Riedel | 36/50 X |
| 4,349,971 | 9/1982 | Everest, III . | |
| 4,404,758 | 9/1983 | Kopp . | |
| 4,499,676 | 2/1985 | Chalmers, II | 36/120 |

FOREIGN PATENT DOCUMENTS

| | | | |
|---|---|---|---|
| 0085026 | 8/1983 | European Pat. Off. | 36/118 |
| 2404447 | 8/1974 | Fed. Rep. of Germany | 36/121 |
| 2732522 | 1/1978 | Fed. Rep. of Germany . | |
| 2262453 | 2/1982 | Fed. Rep. of Germany . | |
| 2454767 | 11/1980 | France . | |
| 549970 | 6/1974 | Switzerland . | |

*Primary Examiner*—James Kee Chi

*Attorney, Agent, or Firm*—Brumbaugh, Graves, Donohue & Raymond

[57] ABSTRACT

This boot comprises an upper pivotable on a lower portion of the boot and adapted to be locked by means of interconnecting means comprising a rack rigid with the upper and a lever fulcrumed to the rack in two guide members in which the pivot pin of the lever is adapted to move parallel to the rack. The lever has an eccentric hub acting as a cam upon a toothed strap, and can be set in three specific position, namely a turn down position in which it engages the boot and the strap is urged against the rack while a male element of the lever engages a female element rigid with the lower portion of the boot, a partially raised position in which the male and female elements are released from each other but the strap is still in engagement with the rack, and a fully raised position in which the strap is released from the rack, the intermediate position being an inoperative or operative position, the third position being an adjustment position.

11 Claims, 5 Drawing Figures

SKI BOOT

BACKGROUND OF THE INVENTION

The present invention relates to ski boots and is directed to provide an improved ski boot consisting of at least one lower portion adapted to surround the foot and of an upper pivotally connected to said lower portion and comprising at the rear means for interconnecting the upper and the lower portion, said means being disposed in a notch cut in a portion of the upper which surrounds at least partially the lower portion of the boot, said interconnecting means comprising a lever adapted to be set in at least two positions, namely a turn-down position in which said lever engages the boot and the upper is locked with respect to the lower portion so as to have a predetermined cant in relation thereto, and a raised position in which the upper can pivot freely, within certain limits, on the lower portion, other means being provided for modifying the locked angular position or cant of the upper.

THE PRIOR ART

A boot of this character is disclosed in the U.S. Pat. No. 4,349,971 owned by the applicant. In this prior art construction the lever controlling the interconnecting means is pivoted at one end to a strap rigid with the lower portion of the boot and at an intermediate point, via a selector nut carried by a screw-threaded rod forming an integral part of said lever, to the end of a link fulcrumed to a strap rigid with the ski boot upper. In the turn-down position the pivot axis of the selector nut is positioned beneath a straight line interconnecting the other two pivot axes, so that the lever is safely held in this turn-down position. The threaded rod rigid with the lever is provided at its end with gripping means enabling the user to rotate this rod for shifting the selector nut. Though the device permits of obtaining a very fine adjustment of the upper inclination, on the other hand it lacks the necessary sturdiness and both the actuation of the lever and the adjustment of its angular position may prove uneasy in actual practice, that is, in the snow. Moreover, in the operative position, when the upper pivots on the lower portion of the boot, all the pivotal connections are strained and interfere with the upper movement. Moreover, it is uneasy to incorporate a resilient coupling means acting as shock absorber in this mechanism.

A simple device, free of any screws or nuts, is also known through the Swiss Pat. No. 549,970. In this device, the lever consists of a resilient strap having its two bent arms engaged in holes provided on either side of a member rigid with the lower portion of the boot. When the lever is pushed downwards, the upper is released, but at the same time the adjustment of the feed angle, that is, the upper cant adjustment is lost.

SUMMARY OF THE INVENTION

It is the primary object of the present invention to provide means for interconnecting the boot upper and the lower portion of the boot without resorting to any screw-threaded adjustment member and without requiring any particular degree of precision in their manufacture, all the component elements being adapted to be manufactured through simple methods, preferably by stamping.

The ski boot according to the present invention is characterized by the fact that said interconnecting means comprise a rack rigid with the upper and extending in the direction thereof, a lever comprising an eccentric hub pivoted about a horizontal pivot pin journalled in two lateral guide means parallel to said rack and formed in a pair of webs formed integrally with said rack, in which said pivot pin can move parallel to the rack, a strap mounted on said pivot pin by means of a pair of elongated holes parallel to said rack, the central face of said strap, which registers with said rack, being provided with teeth, a male element rigid with said lever and adapted to cooperate with a female member rigid with the lower portion of the boot, or inversely, said lever being adapted to be set in three specific positions, namely a turn-down position in which it engages the boot and its eccentric hub urges said strap against said rack while the male element engages the female element, a partially raised position in which said male and female elements are separated from each other but said eccentric hub still bears against said strap, and a third, raised position in which the lever extends at least at right angles to the upper and said strap is not urged against said rack.

By using a cam-shaped eccentric acting as a tightening means, it is possible to partially raise the lever for releasing the upper, however without altering or loosing the adjustment of the forward position. Furthermore, the provision of this eccentric element permits of utilizing guide means and apertures made without any particular precision, since a certain degree of play is by no means detrimental to the proper operation of the device.

In a preferred form of embodiment of the invention, said male element consists of a spherical member rotatably mounted on a horizontal trunnion parallel to said rack and said female element is a recess of cylindrical configuration formed with two aligned lateral slots adapted to receive the ends of the shaft of said spherical member. These slots are relatively wide in comparison with the diameter of the shaft of said spherical member, the assembly being so constructed as to permit the lateral cant of the upper with respect to the boot sole.

In the same preferred form of embodiment the lever consists of two interfitting elements coupled to each other with the interposition of a resilient element between the coupling means, so that the lever has a certain resiliency when pulled, in order to absorb the shocks applied to the skier's leg, said lever being however rigid under compressive stress, a feature particularly advantageous when skiing.

According to another form of embodiment of the present invention, said male element consists of a horizontal elongated block rigid with said lever and adapted to be resiliently retained in a groove formed in a block of resilient material which is rigid with the lower portion of the boot.

The invention will now be described more in detail with reference to the attached drawings showing diagrammatically by way of example two typical forms of embodiment of the invention.

THE DRAWINGS

DESCRIPTION OF THE PREFERRED EMBODIMENTS

Figure 1:
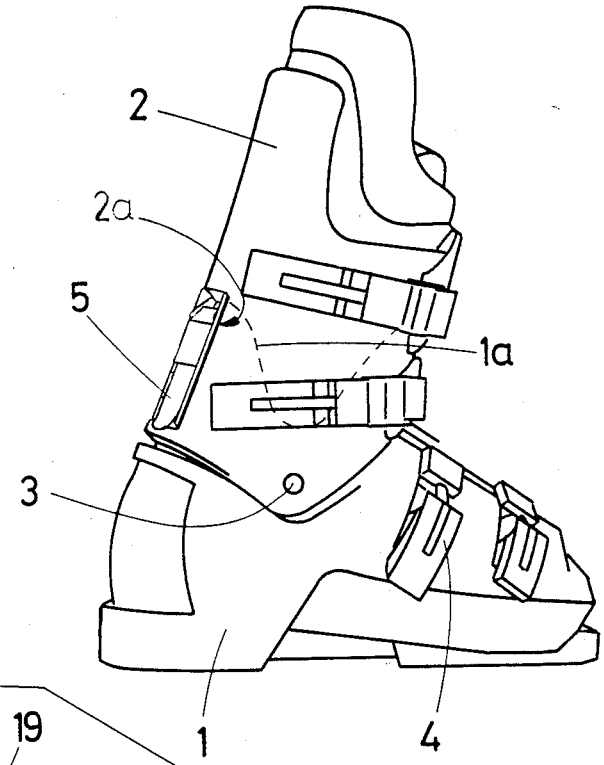
FIG. 1 is a general perspective view of a ski boot provided with the device of this invention, according to a first form of embodiment thereof.

The ski boot illustrates in FIG. 1 is molded from synthetic material and comprises in the known fashion a lower portion or shell 1 incorporating the sole and the vamp and an upper 2 pivotally connected to the shell 1 at two opposite sides 3 of which only one is visible in the drawings. The upper edge 1*a* of shell 1 is amply surrounded by the upper 2 at the front and rear of this upper. The boot is closed in the known fashion by means of four shackles 4. The shell 1 and upper 2 are further interconnected by coupling means 5 embedded in a rectangular notch 2*a* formed at the rear of the upper 2.

Figure 2:
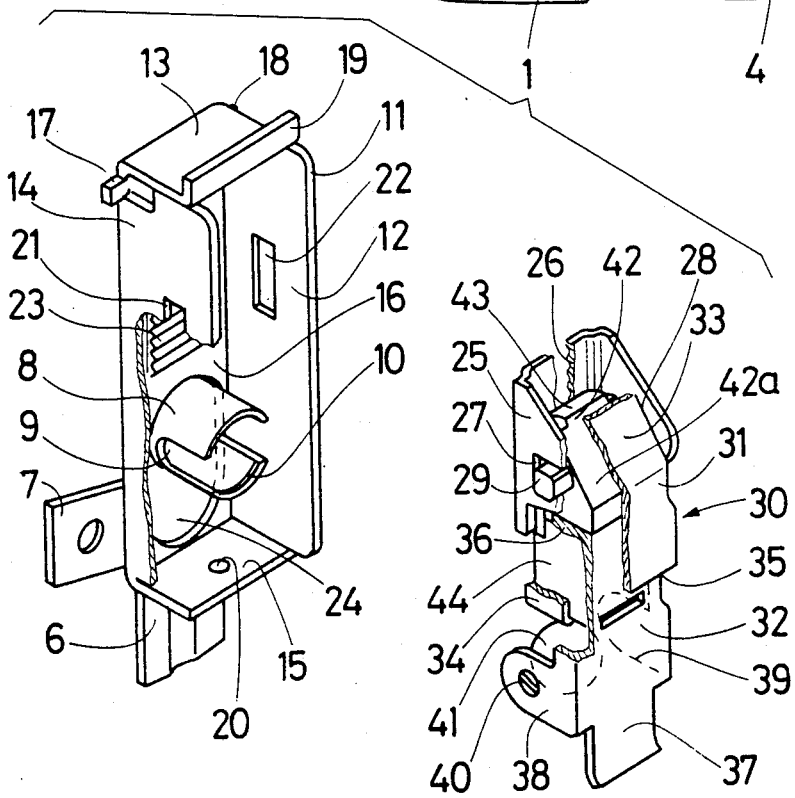
FIG. 2 is an exploded perspective view of the first form of embodiment of the device of this invention.

These connecting means 5 are shown in detail in FIG. 2 and comprise a molded aluminum member 6 secured by means of a pair of lugs 7 and rivets to the shell 1. This molded member 6 comprises a cylindrical projection 8 having a diametral slot 9 formed substantially throughout its axial length, its outer end being provided with a small inner bead 10. Secured in the notch 2*a* of the upper is a metal member 11 obtained by stamping and bending a sheet metal blank forming a kind of box having four side walls 12, 13, 14 and 15 extending at right angles to a bottom 16. This member 11 is secured at its upper end in said notch 2*a* by means of a pair of side lugs 17, 18 fitted under the upper and by a bent edge 19 of face 13, and at the bottom by a screw engaging a tapped hole 20 of face 15. The major parallel faces 12 and 14 further comprise a pair of opposite rectangular apertures 21 and 22 extending parallel to said bottom 16. Formed for example by stamping in this bottom 16 is a rack 23. Under this rack, the bottom 16 is provided with an elongated aperture 24 freely engaged by the cylindrical portion 8 of said molded aluminum member 6.

The connecting means further comprise a strap 25 on which teeth 26 are formed these teeth registering with, and corresponding to, the rack 23 and being parallel to the teeth of this rack. The webs of strap 25 comprise two square apertures 27, 28 formed therein and registering with the rectangular apertures 21 and 22 of member 11. A pivot pin 29 has square-sectioned ends engaging freely said square apertures 27 and 28 and also the apertures 21 and 22 of member 11. Between the webs of strap 25 this pivot pin 29 has a circular cross-section and extends freely through the lever 30 consisting of two interfitting elements 31 and 32 by snap mutual engagemnt. These elements 31 and 32 consist of stamped and bent sheet-metal pieces. Element 31 has a front face 33 formed on either side with lateral webs receiving the cylindrical portion of pin 29 and having lower portions provided with a pair of lugs bent at right angles 34 and 35. The lower portion 32 has an upper end 36 also bent at right angles, a lower end 37 slightly curved to permit the gripping of the lever, and two parallel webs 38 and 39 between which the pivot pin 40 of a spherical member of synthetic, preferably self-lubricating material such as DELRIN (Registered Trade Mark), is mounted, said spherical member being adapted to rotate freely on said pivot pin 40. The upper face of the bent portion 36 bears against an element 42 of synthetic material, for instance DELRIN, constituting the hub of the lever 30 on pivot pin 29. This hub 42 has formed thereon adjacent the strap 25 a cylindrical surface 43 centered in relation to pivot pin 39 but cut by an inclined flat surface 42*a* constituting a tightening cam. The remaining portion of the surface of hub 42 consists of flat faces consistent with the faces of interfitting elements 31 and 32. Between the lugs 34 and 35 on the one hand and the bent portion 36 of the other portion of the lever on the other hand a block of resilient material 44 capable of imparting a certain degree of elasticity under tensile stress to the lever 30 is provided. The element 32 of lever 30 bears against the hard hub 42 so that the lever 30 is not resiliently compressible. Both elements 31 and 32 of lever 30 are thus simply assembled by snap or resilient engagement through their portions 36 and 34–35 with the interposition of a resilient element.

Figure 3:
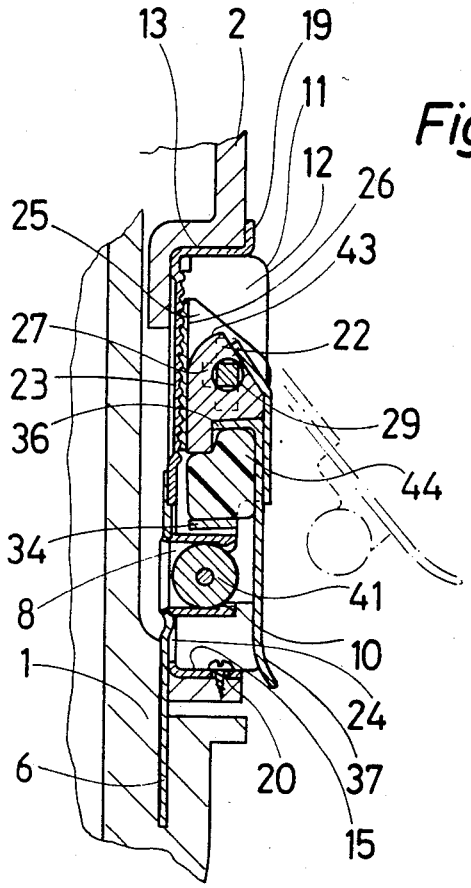
FIG. 3 is a longitudinal section showing the same device in its closed position.

In the closed position of the connecting means such as shown in sectional view in FIG. 3, the strap 25 is strongly pressed against the rack 23 by the hub 42 of lever 30 which in this position acts as a tightening cam, the trunnion 39 bearing against the outer ends of apertures 27 and 28. The plastic spherical member 41 engages the cylindrical recess of portion 8. The shell 1 and upper 2 of the ski boot are thus rigidly connected, except for the elasticity offered by the elastomer block 44. The diameter of the spherical member 41 is slightly greater than that of the inlet of the cylindrical projection 8, so as to retain this spherical member 41 in its recess. The diametral slot 9 of cylindrical projection 8 is substantially wider than the diameter of pivot pin 40 in order to afford a certain degree of rotation of lever 30 about the axis of said cylindrical projection 8 and consequently permit the adjustment of the lateral cant of the boot upper 2 in relation to the shell 1.

In the inoperative or walking position, it is possible to eliminate the connection means 5 between the upper and the shell by slightly lifting the lever 30, as shown in dash and dot lines in FIG. 3, in order to free the spherical member 41 from its recess in the cylindrical projection 8. In this position of lever 30, the strap 25 is still urged by hub 42 against the rack 23 so that the upper cant selected for skiing is preserved. Thus, when the skier turns the lever 30 completely in the skiing position, the upper cant is restored automatically to the value previously selected by the skier.

Figure 4:
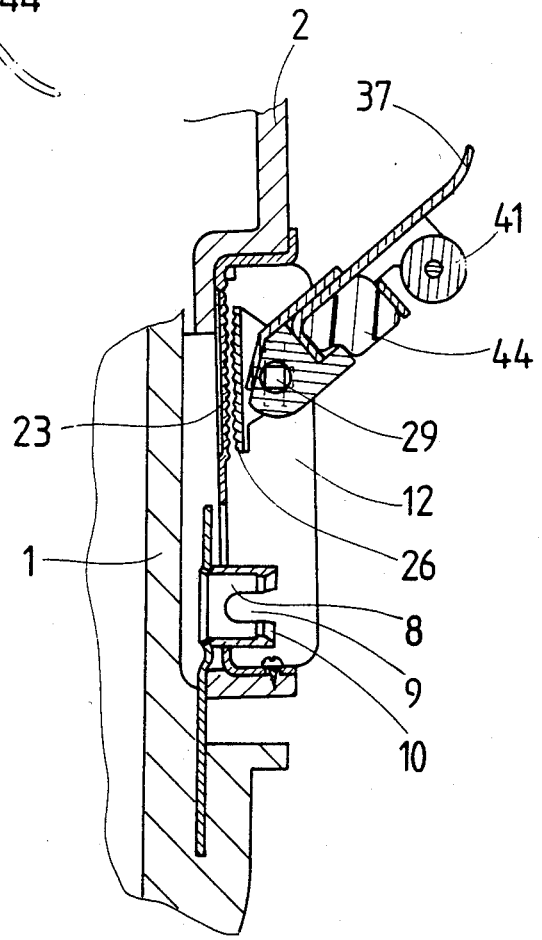
FIG. 4 is a sectional view of the same device in its adjustment position.

If the skier is desirous to change the upper inclination with respect to the shell, he must firstly lift the lever 30 beyond the horizontal, as shown in FIG. 4. In this position, the cylindrical portion 43 of hub 42 does not bear anymore against the bottom of strap 25, and the inclined plane 42*a* now registers with this bottom so that the teeth 26 of the strap are moved away from rack 23. Thus, it becomes possible to move the strap 25 along the walls 12 and 14 of member 11, the trunnion 29 moving in apertures 21 and 22. When the new position has been selected, it is only sufficient to turn down the lever 30 either to the skiing position or to an intemediate oblique position.

Figure 5:
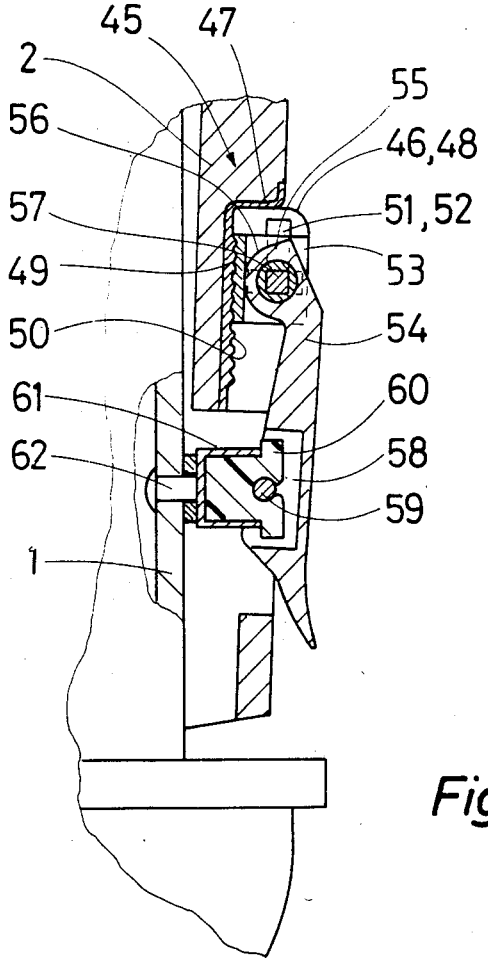
FIG. 5 is a longitudinal section showing a second form of embodiment of the invention.

In the second form of embodiment illustrated in FIG. 5, the connecting means comprise a metal member 45 of stamped and bent sheet-metal, similar to member 11 of the first form of embodiment, which is secured in the notch 2*a* of the upper 2. This member 45 has three sides 46, 47 and 48 bent at right angles with respect to a bottom 49 provided with a rack 50. The sides 46 and 48 are parallel and provided with a pair of rectangular apertures 51 and 52 similar to apertures 21 and 22 of the first form of embodiment. In a strap 53 similar to strap 25 one end of a lever consisting of a metal casting is pivotally mounted and comprises as in the preceding case a hub having a cylindrical portion 55 followed by a flat face 56. This hub is pivoted freely on a shaft 57 of which the two square-sectioned ends extends through matching square-sectioned apertures formed in strap 53 and also through a pair of rectangular apertures 51 and 52 as in the first form of embodiment. The lever 54 comprises a recess 58 receiving a cylindrical trunnion 59 adapted to be snappily engaged in a block 60 of suitable elastomer which is secured in the bottom of a U-shaped element 61 fastened in turn by means of a rivet 62 to the shell 1. The elastomer block 60 has formed therein a groove having an omega or U-shaped cross-section, this groove being adapted to receive the trunnion 59. The same elastomer block 60 imparts a certain degree of resiliency to the connection between the upper and the shell of the boot, both in case of tractive or compressive efforts. In this device is fitted to a boot comprising means for adjusting the lateral cant of the upper in relation to the shell, it is possible that, when the adjustment is accomplished while the connecting device is open, the trunnion 59 be not exactly parallel to the groove of block 60. However, this inconvenience can be avoided by enabling the U-shaped element 61 to pivot freely on its fastening rivet 62 and adjusting the lateral cant in the closed condition of the connecting means.

Of course, this invention lends itself to many modifications and forms of embodiment. More particularly, the male and female elements may be inverted. Thus, in the first form of embodiment described hereinabove the spherical member 41 would be rigid with the lower portion of the boot, and the slotted cylindrical projection 8 would be rigid with the lever. In the second form of embodiment, the elastomer block 60 could be detachably mounted in its strap, so that it can be exchanged for example for another block having a different elasticity.

What is claimed is:

1. A ski boot consisting of at least a lower portion adapted to encompass the foot and of an upper pivotally connected to said lower portion, and comprising at the rear means for interconnecting said upper and said lower portion, said interconnecting means being located in a notch formed in one portion of the upper which surrounds at least partially said lower portion of the boot, said interconnecting means comprising a lever adapted to be set in at least two positons, a first position in which said upper is turned down for engagement with the boot, so that said upper is fastened to said lower portion with a predetermined angle of cant, and a second or raised position in which said upper can pivot freely within certain limits with respect to said lower portion, means being provided for altering the angle of cant of said upper in said first position, wherein said interconnecting means comprise a rack rigid with, and extends along, said upper, a lever having an eccentric hub journalled about a horizontal trunnion mounted in two lateral guide means parallel to, and formed in two side wall rigid with, said rack, in which said trunnion can move in a direction parallel to said rack, a strap mounted on said trunnion and having a toothed central face registering with said rack, a male element rigid with said lever and cooperating by mutual engagement with a female element rigid with said lower portion of the boot, or inversely, said lever being adapted to be set in three specific positions, namely a first position in which said lever is turned down on the boot and its eccentric hub urges said strap against said rack and said male and female elements are partially engaged into each other, a partially raised position in which said male and female elements are released from each other but said eccentric hub is still bearing against said strap, and a position in which said lever is raised by at least 90 degrees and wherein said strap is not urged against said rack.

2. The ski boot of claim 1, wherein said male element consists of a spherical member rotatably mounted on a horizontal pivot pin parallel to said rack, said female element consisting of a substantially cylindrical recess provided with two lateral slots permitting the passage of the pivot pin of said spherical member.

3. The ski boot of claim 2, wherein the inlet of said cylindrical recess has a smaller diameter than said spherical member.

4. The ski boot of claim 2, wherein said lever is resiliently extensible.

5. The ski boot of claim 4, wherein said lever consists of two interfitting sections held in snapped mutual engagement, with a resilient element disposed between said sections.

6. The ski boot of claim 4, wherein said hub consists of a self-lubricating material.

7. The ski boot of claim 5, wherein said two sections constituting said lever are stamped from sheetmetal blanks, said snappily interfitting sections being obtained by bending at right angles said side portions of the blanks.

8. The ski boot of claim 5, wherein said resilient element is detachable and interchangeable.

9. The ski boot of claim 1, wherein said male element consists of a horizontal trunnion parallel to said rack, and said female element consists of a block of resilient material in which a groove parallel to said male element trunnion is formed and adapted to receive said male element trunnion by force-fitting.

10. The ski boot of claim 9, wherein the width of the inlet of said groove is narrower than its major width and wider than the diameter of said trunnion.

11. The ski boot of claim 9, wherein said block of resilient material is detachably mounted in a metal strap.

* * * * *